US007240441B2

(12) United States Patent
McCoy

(10) Patent No.: US 7,240,441 B2
(45) Date of Patent: Jul. 10, 2007

(54) EXCAVATOR THUMB FOR USE WITH EXCAVATOR EQUIPMENT

(76) Inventor: Ted McCoy, 555 Freeman Rd., Unit 231, Central Point, OR (US) 97502

( * ) Notice: Subject to any disclaimer, the term of this patent is extended or adjusted under 35 U.S.C. 154(b) by 86 days.

(21) Appl. No.: 11/058,091

(22) Filed: Feb. 14, 2005

(65) Prior Publication Data

US 2005/0193599 A1 Sep. 8, 2005

Related U.S. Application Data

(60) Provisional application No. 60/544,538, filed on Feb. 12, 2004.

(51) Int. Cl.
*E01H 5/04* (2006.01)

(52) U.S. Cl. ..... 37/406; 37/403; 37/903; 414/724

(58) Field of Classification Search ..... 37/403, 37/406, 903; 414/729, 724, 912
See application file for complete search history.

(56) References Cited

U.S. PATENT DOCUMENTS

| | | | | |
|---|---|---|---|---|
| 3,674,162 | A * | 7/1972 | Smith | 414/694 |
| 3,828,950 | A * | 8/1974 | Schwantes | 414/694 |
| 4,283,866 | A * | 8/1981 | Ogawa | 37/406 |
| 4,375,345 | A | 3/1983 | Hanson | |
| 4,466,494 | A | 8/1984 | Hanson | |
| 4,519,739 | A | 5/1985 | Risch | |
| 4,635,386 | A * | 1/1987 | Kobayasi | 37/406 |
| 4,770,597 | A | 9/1988 | Powers | |
| 4,803,788 | A | 2/1989 | Sorenson | |
| 4,804,309 | A | 2/1989 | Risch | |
| 4,845,867 | A | 7/1989 | Albrecht | |
| 4,932,832 | A | 6/1990 | McCasland et al. | |
| 5,111,602 | A | 5/1992 | Risch | |
| 5,553,408 | A | 9/1996 | Townsend | |
| 5,678,332 | A | 10/1997 | Hawkins | |
| 5,813,822 | A | 9/1998 | Pisco | |
| 5,927,933 | A * | 7/1999 | Tucker | 414/729 |
| 5,972,933 | A | 10/1999 | Pfirrmann | |
| 6,203,267 | B1 * | 3/2001 | Heiple et al. | 414/722 |
| 6,209,237 | B1 | 4/2001 | Heiple et al. | |
| 6,260,294 | B1 | 7/2001 | Pitcher | |
| 6,385,870 | B1 | 5/2002 | Webel et al. | |
| 6,453,586 | B1 * | 9/2002 | Wolin et al. | 37/406 |
| 6,640,471 | B2 | 11/2003 | Desrochers | |
| 6,742,291 | B2 * | 6/2004 | Frigon et al. | 37/406 |
| 6,843,005 | B2 * | 1/2005 | Clapper | 37/406 |
| 7,037,064 | B2 * | 5/2006 | Heiple | 414/729 |

FOREIGN PATENT DOCUMENTS

| | | |
|---|---|---|
| JP | 4-202917 | 7/1992 |
| WO | WO89/12145 | 12/1989 |

* cited by examiner

*Primary Examiner*—Thomas A Beach

(57) ABSTRACT

An excavator thumb assembly for use with an excavator having a boom, a hydraulic cylinder, a hydraulic cylinder shaft that extends and retracts from the hydraulic cylinder, and a bucket pivotally attached to an end of the boom and operatively attached to the hydraulic cylinder shaft. The excavator thumb assembly includes a thumb pivot plate attached to an intermediate portion of the boom. The thumb pivot plate has a thumb attachment point positioned above the longitudinal axis of the boom. The excavator thumb assembly also includes a thumb pivotally attached to the thumb attachment point along a thumb pivot axis, and operatively attached to the hydraulic cylinder shaft. The excavator thumb assembly is configured so that the thumb and bucket opposably grab and release objects as the hydraulic cylinder shaft extends and retracts, respectively.

11 Claims, 4 Drawing Sheets

EXCAVATOR THUMB FOR USE WITH EXCAVATOR EQUIPMENT

CROSS-REFERENCE TO RELATED APPLICATIONS

This application claims priority under 35 U.S.C. §119(e) to U.S. Provisional Patent Application Ser. No. 60/544,538 entitled "Excavator Thumb For Use With Excavator Equipment," filed Feb. 12, 2004, the entire disclosure of which is herein incorporated by reference for all purposes.

BACKGROUND

Excavating equipment is commonly used for construction projects that require builders and contractors to move large amounts of earth, rocks and other materials. Backhoes and other types of excavating equipment commonly include a boom, or dipper stick, that extends from the main body, and a bucket pivotally attached to the end of the arm. The bucket is typically controlled by hydraulics mounted above the arm. While these types of excavators are well suited for moving loose dirt and small rocks, they are not well suited for picking up larger objects that do not fit easily into the bucket.

Some excavators also include a fixed or movable thumb that opposes the movement of the bucket and facilitates grabbing and moving rocks, pipes, concrete, trees, and other larger objects. The use of thumbs can decrease the amount of time required for a given project. Examples of excavating equipment with a fixed or movable thumb may be found in U.S. Pat. Nos. 4,131,210; 4,375,345; 4,466,494; 4,519,739; 4,770,597; 4,803,788; 4,804,309; 4,845,867; 4,932,832; 5,111,602; 5,553,408; 5,678,332; 5,813,822; 5,972,933; 6,209,237; 6,260,294; 6,385,870; 6,640,471; Japanese Patent No. 4-202917; and PCT Application WO 89/12145, the entire disclosures of which are herein incorporated by reference for all purposes.

DETAILED DESCRIPTION

Figure 1:
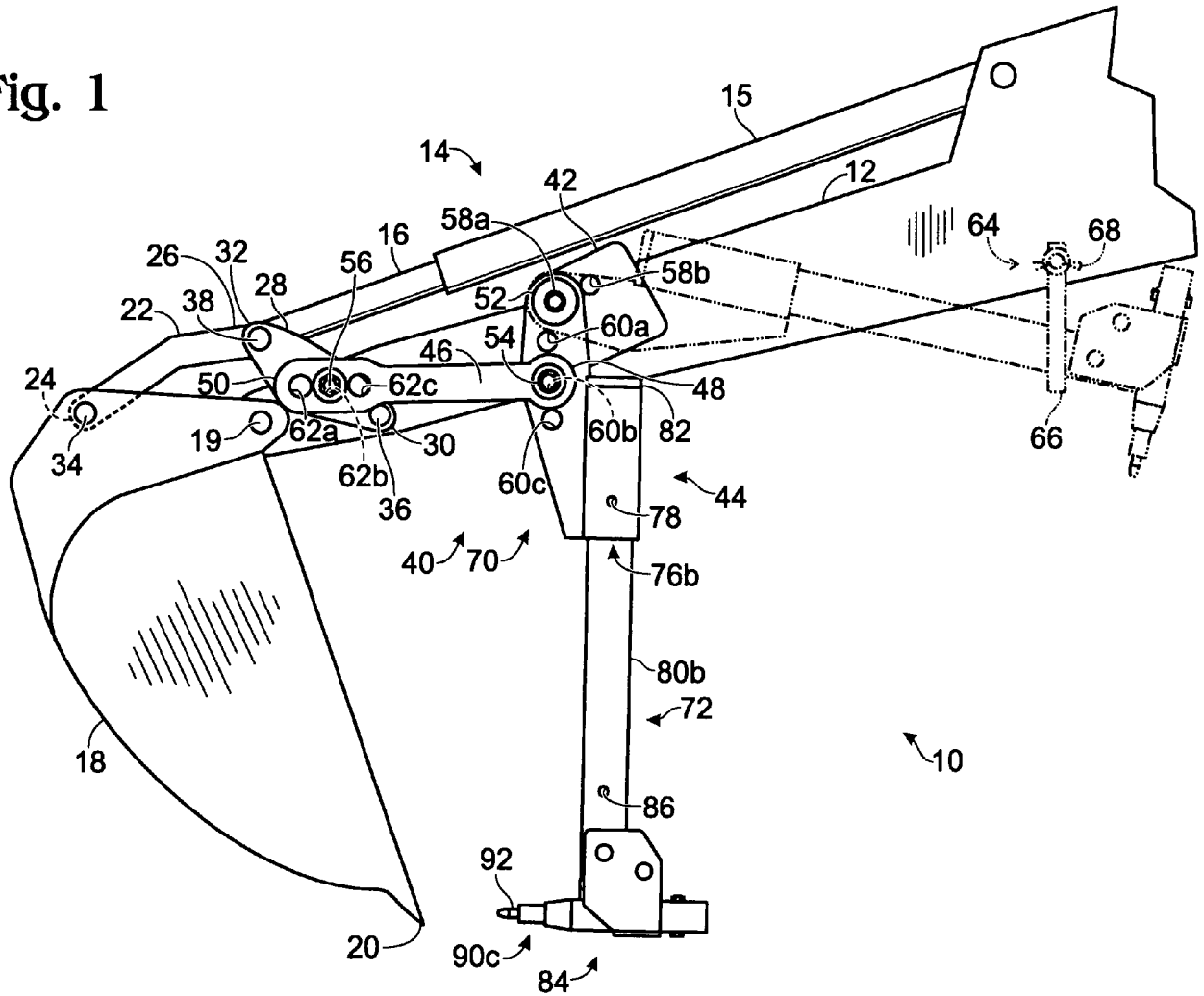
FIG. 1 is a side view of an excavator with a bucket and an excavator thumb assembly, depicting the bucket and the excavator thumb assembly in a fully closed position, and the excavator thumb in a detached and secured position.
Figure 2:
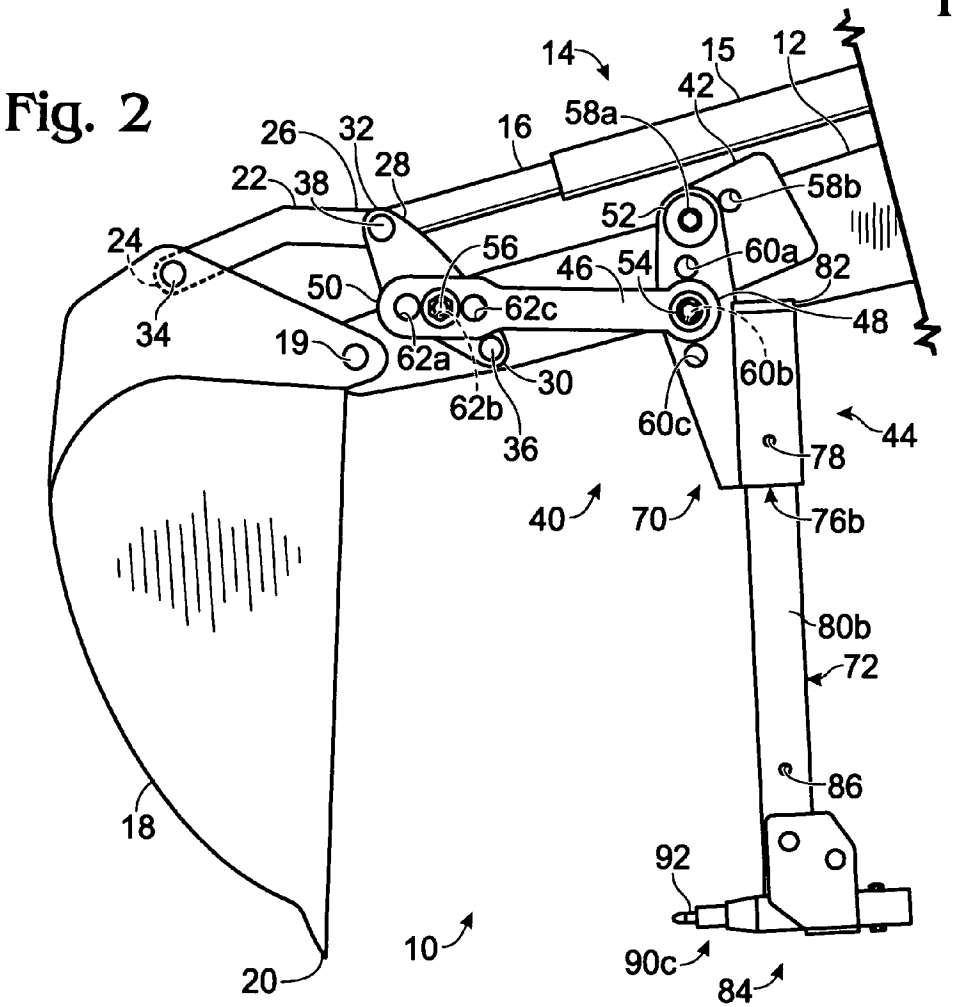
FIG. 2 is a side view of the excavator of FIG. 1 depicting the bucket and the excavator thumb assembly in an intermediate position.
Figure 3:
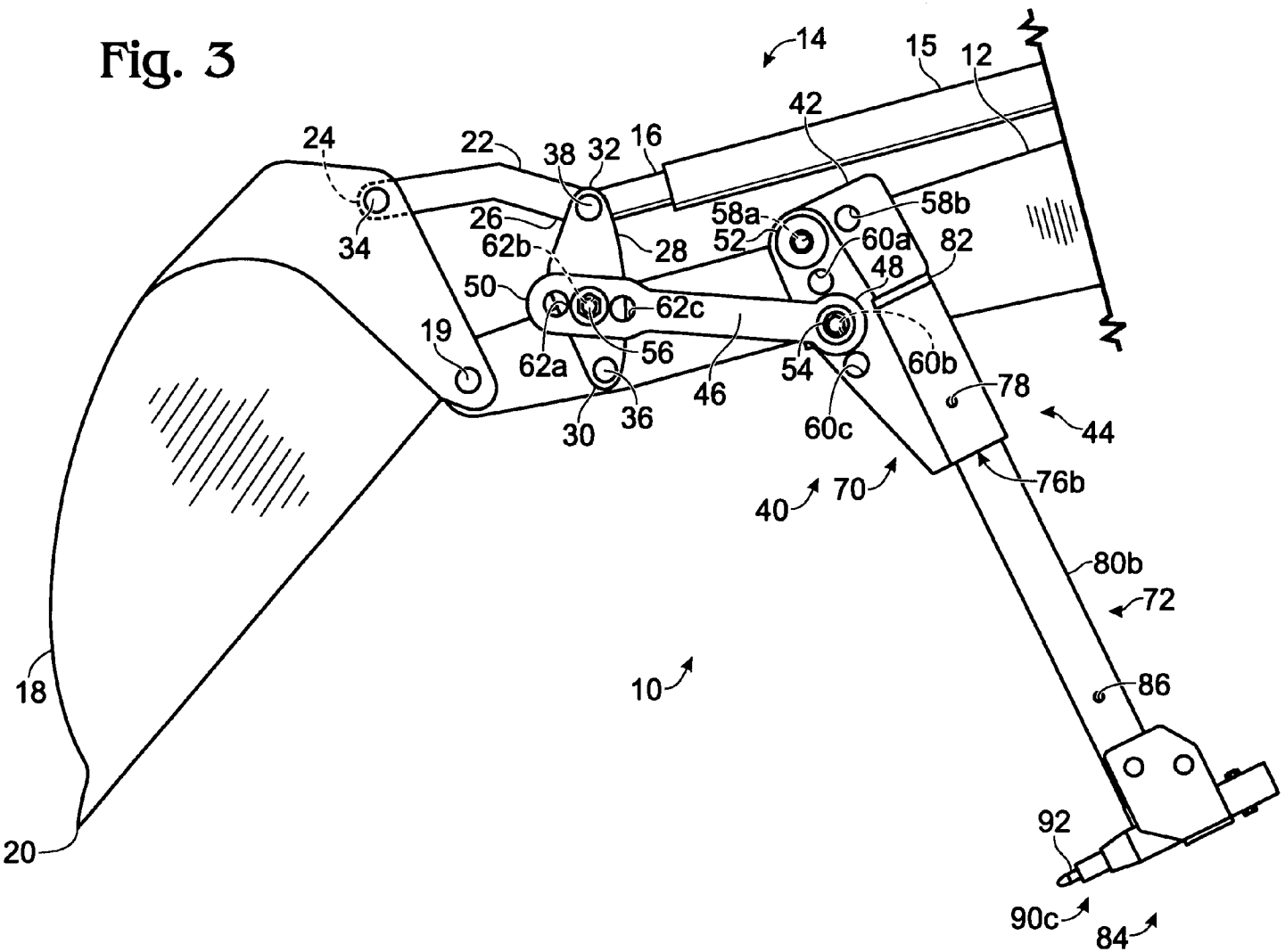
FIG. 3 is a side view of the excavator of FIG. 1 depicting the bucket and the excavator thumb assembly in a fully open position.

FIGS. 1-3 show a side view of an excavator 10. The excavator 10 may include: a boom 12; a hydraulic mechanism 14 with a hydraulic cylinder 15 and a hydraulic cylinder shaft 16; a bucket 18 with teeth 20; a bucket linkage arm 22 with a first end 24 and a second end 26; and a cam 28 with a first end 30 and a second end 32. The bucket 18 is pivotally attached to the end of the boom 12 with a bucket pivot pin 19. The first end 24 of the bucket linkage arm 22 is pivotally attached to the bucket 18 with a bucket link pin 34. The first end 30 of the cam 28 is pivotally attached to the boom 12 with a lower cam link pin 36. The second end 32 of the cam 28 is pivotally attached to the second end 26 of the bucket linkage arm 22, and to the end of the hydraulic cylinder shaft 16, with an upper cam link pin 38. It should be appreciated to one skilled in the art that some of these structures, as well as other structures discussed below, may include complimentary structures on the opposite side of the boom that are functionally identical.

The hydraulic cylinder 15 of the hydraulic mechanism 14 retracts/extends the hydraulic cylinder shaft 16, which actuates pivotal opening/closing of the bucket 18 through the backward/forward pivot of the cam 28. For example, FIG. 1 shows the hydraulic cylinder shaft 16 in a retracted position, which pivots cam 28 into a backward position, which pivots the bucket 18 into a fully open position through the bucket linkage arm 22. FIG. 2 shows the hydraulic cylinder shaft 16 in an intermediate position, which pivots the cam 28 into an intermediate position, which pivots the bucket 18 into an intermediate position through the bucket linkage arm 22. FIG. 3 shows the hydraulic cylinder shaft 16 in an extended position, which pivots the cam 28 into a forward position, which pivots the bucket 18 into a fully closed position through the bucket linkage arm 22.

As shown in FIGS. 1-3, the excavator 10 may also include an excavator thumb assembly 40 operatively connected to the hydraulics of the excavator. Specifically, the excavator thumb assembly 40 may include a thumb pivot element 42, an excavator thumb 44, and an actuator 46 with a first end 48 and a second end 50. The thumb pivot plate 42 may be attached to a relatively intermediate, or central portion of the boom 12. The point that the thumb pivot plate 42 is attached to the boom 12 relative to the bucket 18 affects the maximum opening width between the bucket 18 and the excavator thumb 44. The excavator thumb 44 may be pivotally attached to the thumb pivot plate 42 with a thumb pivot pin 52. The first end 48 of the actuator 46 may be pivotally attached to the excavator thumb with a thumb/actuator pivot pin 54. The second end 50 of the actuator 46 may be pivotally attached to the cam 28 with a cam/actuator pivot pin 56. The point that the second end 50 attaches to the cam 28 affects the maximum opening width between the bucket 18 and the excavator thumb 44, as well as the stroke and torque conferred to the excavator thumb 44 by the hydraulic mechanism 14.

The hydraulic cylinder 15 of the hydraulic mechanism 14 retracts/extends the hydraulic cylinder shaft 16, which actuates pivotal opening/closing of the excavator thumb 44 through the backward/forward pivot of the cam 28. For example, FIG. 1 shows the hydraulic cylinder shaft 16 in a retracted position, which pivots cam 28 into a backward position, which in turn pivots the excavator thumb 44 into a fully open position through the actuator 46. FIG. 2 shows the hydraulic cylinder shaft 16 in an intermediate position, which pivots the cam 28 into an intermediate position, which in turn pivots the excavator thumb 44 into an intermediate position through the actuator 46. FIG. 3 shows the hydraulic cylinder shaft 16 in an extended position, which pivots the cam 28 into a forward position, which in turn pivots the excavator thumb 44 into a fully closed position through the actuator 46. Because the opening and closing of the excavator thumb 44 is coincident to the opening and closing of the bucket 18, the excavator thumb 44 and the bucket 18 may function as opposable structures for grabbing and lifting rocks, concrete, or any other large object. The opposability of the excavator thumb 44 and the bucket 18 may be driven by a single hydraulic mechanism 14, as described herein.

The thumb pivot plate 42 may include one or more thumb attachment points, such as thumb attachment points 58*a* and 58*b*, fixedly positioned at varying distances from the bucket 18 along the longitudinal axis of the boom 12. The excavator thumb 44 may be pivotally attached to either thumb attachment point 58*a* or 58*b* with the thumb pivot pin 52. As indicated above, the thumb pivot plate 42 may be attached to a relatively central portion of the boom 12, where the location that it is attached relative to the bucket 18 affects the maximum opening width between the bucket 18 and the excavator thumb 44. Likewise, the particular thumb attachment point 58*a* or 58*b* to which the excavator thumb 44 is pivotally attached affects the maximum opening width between the bucket 18 and the excavator thumb. Therefore a user may select a particular thumb pivot axis based on their desired maximum opening width between the bucket 18 and the excavator thumb 44.

A shown in FIGS. 1-3, the selectable thumb pivot axes may be positioned above the longitudinal axis of the boom 12. By positioning the thumb's pivot axis above the longitudinal axis of the boom 12, a user may select more configurations of the excavator thumb assembly 40 with a wider variety of mechanical characteristics than they would be able to select if the thumb's pivot axis were positioned below the longitudinal axis of the boom. Specifically, positioning the thumb's pivot axis above the longitudinal axis of the boom 12 provides users with the ability to orient the actuator 46 so that its longitudinal axis is substantially perpendicular to the longitudinal axis of the excavator thumb 44, such that more torque and/or stroke may be conferred to the excavator thumb 44 by the hydraulic mechanism 14. In contrast, positioning the thumb's pivot axis below the longitudinal axis of the boom, such as entirely below the boom, would prevent a user from selecting configurations where the actuator is oriented in a manner relatively perpendicular to the excavator thumb 44.

The excavator thumb 44 may include one or more thumb/actuator attachment points, such as thumb/actuator attachment points 60*a*, 60*b* and 60*c*. The first end 48 of the actuator 46 may therefore be pivotally attached to any one of the thumb/actuator attachment points 60*a*, 60*b* or 60*c* with the thumb/actuator pivot pin 54. As shown in FIGS. 1-3, the thumb/actuator attachment points 60*a*, 60*b* and 60*c* may be located at varying distances from the thumb's pivot axis. This may permit a user to variably select the maximum opening width between the bucket 18 and the excavator thumb 44, as well as the maximum stroke and torque conferred to the excavating thumb 44 by the hydraulic mechanism 14.

The second end 50 of the actuator 46 may include one or more cam/actuator attachment point, such as cam/actuator attachment points 62*a*, 62*b* and 62*c*. The second end 50 of the actuator 46 may therefore be pivotally attached to the cam 28 with the cam/actuator pivot pin 56, by using any one of the cam/actuator attachment points 62*a*, 62*b* or 62*c*. The cam/actuator attachment points 62*a*, 62*b* and 62*c* may be located along the longitudinal axis of the actuator at varying distances from the first end 48 of the actuator 46. This may permit a user to variably select the maximum opening width between the bucket 18 and the thumb 44.

The excavator thumb assembly 40 may be operatively disengageable from the hydraulic mechanism 14, and may including a securing mechanism 64 for securing the excavator thumb 44 to the boom 12. Specifically, thumb/actuator pivot pin 54 and/or cam/actuator pivot pin may be removable, so as to operatively disengage the excavator thumb 44 from the cam 28. The excavator thumb 44 may then be free to pivot about its pivot axis independently of the hydraulic action of the hydraulic mechanism 14. A user may manually pivot the excavator thumb 44 away from the bucket 18 until it comes into contact with the boom 12. The excavator thumb 44 may then be secured to the boom 12 with any suitable securing mechanism. For example, as shown in FIG. 1, the securing mechanism 64 may include a clamp 66 that fits over the excavator thumb 44 and is attached to the boom by a pin 68. The securing mechanism may also include hooks and eyelets, latches, rods, or any other suitable securing mechanism.

Figure 4:
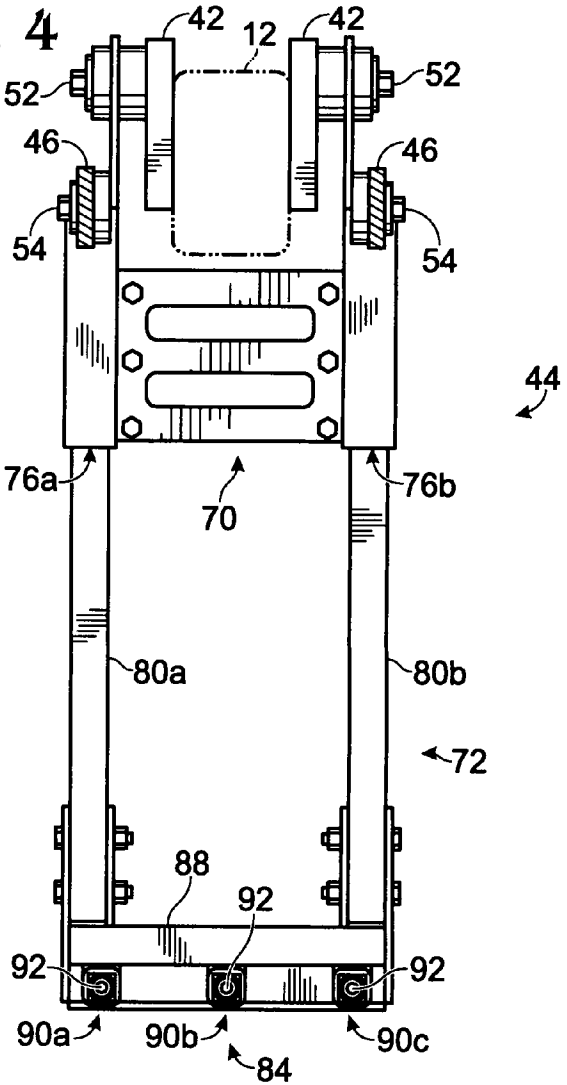
FIG. 4 is front view of the excavator thumb of FIG. 1.
Figure 5:
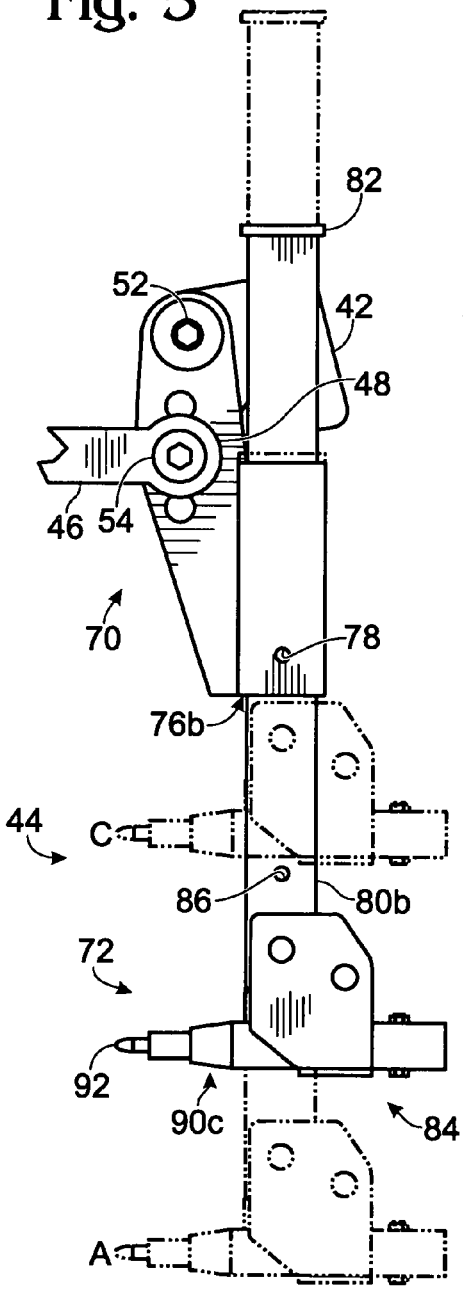
FIG. 5 is a side view of the excavator thumb assembly of FIG. 1, depicting the retractable portion in a fully retracted position, and a fully extended position.

As best shown in FIG. 4, the excavator thumb 44 may include a fixed portion 70 and a retractable portion 72. The fixed portion 70 may be pivotally attached by thumb pivot pin 52 to one of the at least one thumb attachment points 58*a* or 58*b*, and may include the thumb/actuator attachment points 60*a*, 60*b* and 60*c*, as discussed above. The fixed portion 72 may include apertures 76*a* and 76*b*, and retaining pin hole 78. Apertures 76*a* and 76*b* may be configured to slidably engage shafts 80*a* and 80*b*, respectively, as described below. As shown in FIG. 5, the retaining pin hole 78 may be configured to be receive a retaining element, such as a retaining pin (not shown) that spans the aperture 76 so as to engage a hole 86 in the shaft 80, as described below.

As shown in FIG. 5, the retractable portion 72 may be movable between a fully extended position A, and a fully retracted position B. Specifically, the retractable portion 72 may be biased towards the fully extended position A by gravitational forces, and/or by some other suitable biasing mechanism. The retractable portion 72 may be urged towards the fully retracted position, or towards an intermediate position, by applying an upwards force. For example, upward force may be applied to the retractable portion 72 during operation of the excavator 10, such as when the excavator thumb 44 makes contact with the ground while digging with the bucket. As shown in FIG. 4, the retractable portion 72 may include shafts 80*a* and 80*b* and an engagement member 84 attached to the bottom of the shafts, which prevents the shafts from retracting beyond the fully retracted position B. Shafts 80*a* and 80*b* may be slidably engaged with the fixed portion 70 through the apertures 76*a* and 76*b*, respectively. Shafts 80*a* and 80*b* may include a top stopping member 82*a* and 82*b*, respectively, which may be configured to retain the shafts 80*a* and 80*b* within the apertures 76*a* and 76*b* when gravitational forces pull the retractable portion 72 into the fully extended position A. As shown in FIG. 5, the shaft 80 may also include a hole 86 configured to receive a retaining element, such as a retaining pin (not shown). Specifically, when the retractable portion 72 is in a substantially retracted position, hole 86 may be configured to line up with retaining pin hole 78 of the fixed portion 70. A retaining pin (not shown) may then be inserted through the retaining pin hole 78 and hole 86 to hold the retractable portion 72 in a substantially retracted position.

The engagement member 84 may be configured to engage rocks or other large objects during operation of the excavator 10. As shown in FIG. 4, the engagement member 84 may include a support member 88 and one or more teeth 90, such as teeth 90*a*, 90*b*, and 90*c*, attached to the support member. The support member 88 may be fixedly attached to the ends of shafts 80*a* and 80*b*. The support member may also be removably, slidably or fixedly attached to the ends of the shafts, to permit a user to exchange the engagement member 84 for an alternative engagement member 84, or to vary the orientation of the engagement member 84 relative to the complimentary shafts 80, as desired. Likewise, teeth 90*a*, 90*b* and 90*c* may be fixedly attached to the support member 88. The teeth 90*a*, 90*b* and 90*c* may also be removably, slidably and/or pivotally attached to the support member, to permit a user to replace damaged teeth, or to vary the orientation of the teeth relative to the complimentary shafts 80 as desired. The teeth 90*a*, 90*b* and 90*c* may include a tip 92 made of steel, carbide, or any other suitable material for gripping rocks, concrete or other large materials. The tip 92 may be removably attached to the remained of the tooth to permit a user to replace a damaged tip.

Figure 6:
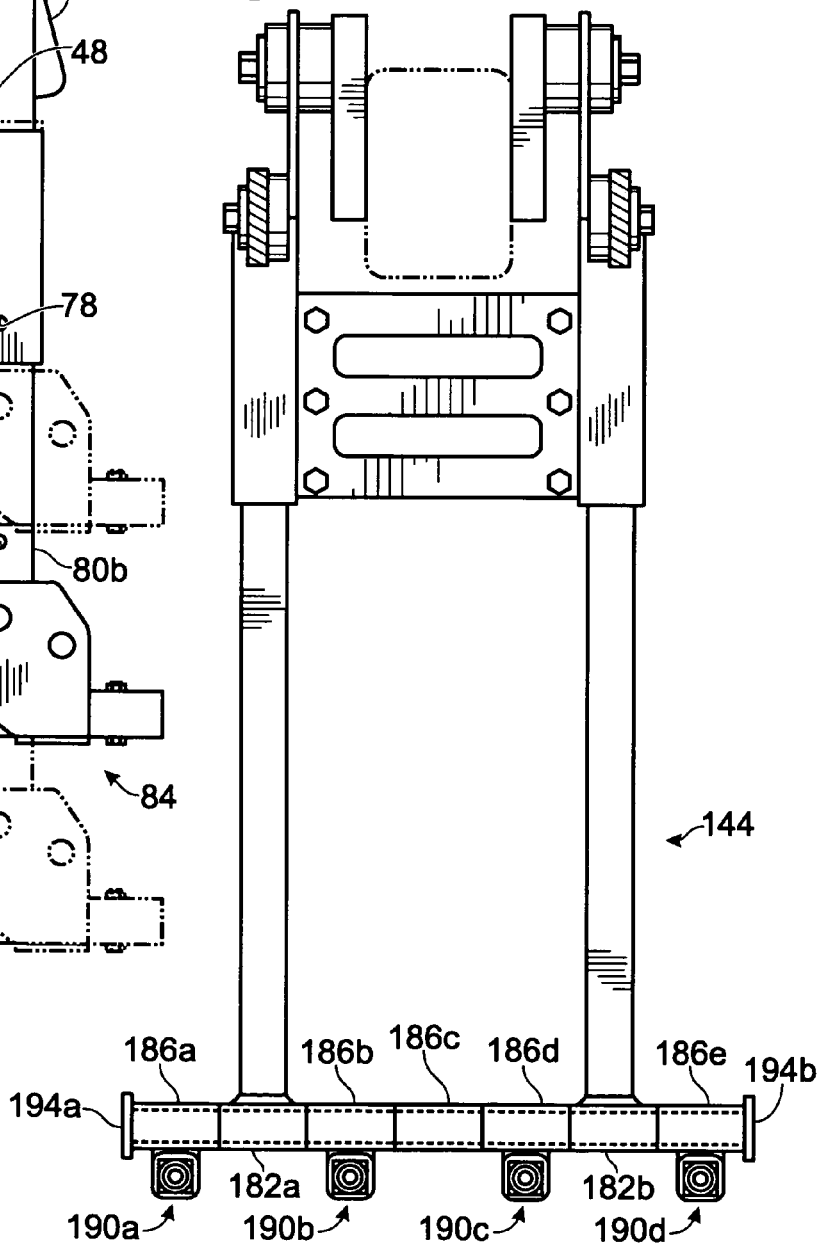
FIG. 6 is a front view of a second excavator thumb.

FIG. 6 shows an embodiment of an excavator thumb 144. Similar to the embodiment shown in FIGS. 1-5, the excavator thumb 144 may include a fixed portion 170, and a retractable portion 172 with shafts 180*a* and 180*b* and an engagement member 184. Unlike the embodiment shown in FIGS. 1-5, the engagement member 184 may include: a support member 188; fixed receiving members 182*a* and 182*b*; a plurality of removable receiving members, such as receiving members 186*a*, 186*b*, 186*c*, 186*d*, and 186*e*; one or more teeth, such as teeth 190*a*, 190*b*, 190*c* and 190*d*; and end plates 194*a* and 194*b*. The support member 188 may be a bar, rod, shaft or other suitable support member. The fixed receiving members 182*a* and 182*b* may be a cuff, sleeve, tube, or other suitable receiving member, and may be fixedly attached to the bottom end of the shafts 180*a* and 180*b*, respectively. The receiving members 186*a-e*, may be substantially the same as receiving members 182*a* and 182*b*, except that they are not fixedly attached to the shafts 180*a* or 180*b*. The teeth, such as teeth 190*a-d*, may be fixedly attached to some or all of the receiving members 186*a-e*.

The engagement member 184 may be assembled as show in FIG. 6. Specifically, the height and width of the support member 188 and the receiving members 182*a*, 182*b* and 186*a-e* may be selected to so that the support member may be slidably engaged with each of the receiving members. Further, receiving members 182*a* and 182*b* may be oriented in such a fashion that the support member 188 and the receiving members 182*a*, 182*b*, and 186*a-e* may be assembled similar to a string of pearls, as shown. After assembly, end plates 194*a* and 194*b* may be either fixedly or removably attached to the ends of the support member 188 to prevent support member from slidably disengaging from the receiving members during operation of the excavator 10. Preferably, little or no space will be left between each of the receiving members 182*a*, 182*b* or 186*a-e* along the length of the support member 188, and spacers (not shown) may be used to ensure a snug fit. It should be appreciated that a user may variably select the number of teeth they want the engagement member 184 to include. Specifically, a user may include fewer teeth by simply using receiving members that do not have teeth attached to them. A user may include more teeth by making sure that all of the receiving members have teeth attached to them, or by using a longer support member 188. Further, receiving members may be provided that allow teeth to be removably, pivotally or slidably attached to them, such that a user may add or remove teeth, may replace damaged teeth, or may vary the orientation of the teeth relative to the shafts 180*a* and 180*b*, as desired.

The specific embodiments of an excavator thumb for excavator equipment as disclosed and illustrated herein are not to be considered in a limiting sense as numerous variations are possible. The subject matter of this disclosure includes all novel and non-obvious combinations and subcombinations of the various features, elements, functions and/or properties disclosed herein. No single feature, function, element or property of the disclosed embodiments is essential. The following claims define certain combinations and subcombinations which are regarded as novel and non-obvious. Other combinations and subcombinations of features, functions, elements and/or properties may be claimed through amendment of the present claims or presentation of new claims in this or a related application. Such claims, whether they are different, broader, narrower or equal in scope to the original claims, are also regarded as included within the subject matter of the disclosure.

I claim:

1. An excavator thumb assembly for use with an excavator having a boom, a hydraulic cylinder, a hydraulic cylinder shaft that extends and retracts from the hydraulic cylinder, a bucket, a bucket linkage arm, and a cam, where the bucket is pivotally attached to an end of the boom along a first pivot axis, a first end of the cam is pivotally attached to the boom along a second pivot axis, a first end of the bucket linkage arm is pivotally attached to the bucket along a third pivot axis, a second end of the bucket linkage arm is pivotally attached to a second end of the cam along a fourth pivot axis, and the hydraulic cylinder shaft is pivotally attached to the second end of the cam along the fourth pivot axis, the excavator thumb assembly comprising:

a thumb pivot plate attached to an intermediate portion of the boom and including a thumb attachment point positioned above the longitudinal axis of the boom;

a thumb pivotally attached to the thumb attachment point along a fifth pivot axis, and including a thumb/actuator attachment point; and an actuator including:

a first end pivotally attached to the thumb/actuator attachment point along a sixth pivot axis; and a second end that includes a cam/actuator attachment point pivotally attached to the cam along a seventh pivot axis;

wherein the excavator thumb assembly is configured so that the thumb and bucket opposably grab and release objects as the hydraulic cylinder shaft extends and retracts, respectively.

2. The excavator thumb assembly of claim 1, the actuator and thumb each having a longitudinal axis, wherein the longitudinal axis of the actuator is oriented to be substantially perpendicular to the longitudinal axis of the thumb.

3. The excavator thumb assembly of claim 1, the boom having a longitudinal axis, wherein the thumb pivot plate includes more than one thumb attachment point positioned above the longitudinal axis of the boom, and at varying distances from the bucket along the longitudinal axis of the boom, and wherein the thumb is pivotally attachable to any one of the more than one thumb attachment points.

4. The excavator thumb assembly of claim 1, wherein the thumb includes more than one thumb/actuator attachment point, and wherein the first end of the actuator is pivotally attachable to any one of the more than one thumb/actuator attachment points.

5. The excavator thumb assembly of claim 1, wherein the second end of the actuator includes more than one cam/actuator attachment point, and wherein any one of the more than one cam/actuator attachment points is pivotally attachable to the cam.

6. The excavator thumb assembly of claim 1, wherein the thumb includes a first portion pivotally attached to the thumb attachment point along the fifth pivot axis, and a second portion slidably engaged with the first portion, and movable between extended and retracted positions relative to the fifth pivot axis.

7. The excavator thumb assembly of claim 6, wherein the second portion is biased by gravitational forces to move toward the extended position, and is securable in the retracted position by a retaining element.

8. The excavator thumb assembly of claim 6, wherein second portion includes an engagement member configured to engage objects as they are opposably grabbed by the bucket and the thumb.

9. The excavator thumb assembly of claim 8, wherein the engagement member includes at least one tooth for engaging objects.

10. The excavator thumb assembly of claim 9, wherein the at least one tooth includes a carbide tip that is removably attached to the engagement member.

11. The excavator thumb assembly of claim 1, wherein the first end of the actuator is pivotally attached to the thumb/actuator attachment point with a thumb/actuator pivot pin, the second end of the actuator is attached to the cam/actuator attachment point with a cam/actuator pivot pin, and wherein at least one of the thumb/actuator pivot pin and the cam/actuator pivot pin are removable so as to operatively detach the thumb from the hydraulic cylinder shaft; and wherein the excavator thumb assembly further includes a securing mechanism for securing the operatively detached thumb to the boom.

* * * * *